US006341824B1

(12) United States Patent
Boucherie

(10) Patent No.: US 6,341,824 B1
(45) Date of Patent: Jan. 29, 2002

(54) METHOD AND DEVICE FOR FORMING FIBER PACKS FOR MANUFACTURING BRUSHES FROM A FIBER STRAND

(75) Inventor: Bart Gerard Boucherie, Izegem (BE)

(73) Assignee: Firma G. B. Boucherie, naamloze vennootschap (BE)

( * ) Notice: Subject to any disclaimer, the term of this patent is extended or adjusted under 35 U.S.C. 154(b) by 0 days.

(21) Appl. No.: 09/523,464

(22) Filed: Mar. 10, 2000

(30) Foreign Application Priority Data

Mar. 10, 1999 (BE) ..... 09900166

(51) Int. Cl.[7] ..... A46D 1/66; A46D 1/08
(52) U.S. Cl. ..... 300/7; 300/5; 300/21
(58) Field of Search ..... 15/169, 201; 300/4, 300/5, 2, 8, 9, 18, 21

(56) References Cited

U.S. PATENT DOCUMENTS 4,680,850 A 7/1987 Boucherie
4,884,849 A 12/1989 Shaw
5,344,218 A 9/1994 Weihrauch
5,431,484 A 7/1995 Zohoransky et al.
5,690,394 A * 11/1997 Boucherie
5,913,348 A * 6/1999 Horton

FOREIGN PATENT DOCUMENTS

DE 195 25 208 A1 1/1997

* cited by examiner

*Primary Examiner*—Terrence R. Till
(74) *Attorney, Agent, or Firm*—Bacon & Thomas, PLLC

(57) ABSTRACT

A method and device for forming fiber packs for manufacturing brushes from a fiber strand. The fiber packs (2) are formed from a fiber strand (1) which is provided with a cover (4) by cutting off parts (5) of this fiber strand (1), wherein, before such a part (5) is cut off, the cover (4) is entirely removed from said part (5).

17 Claims, 4 Drawing Sheets

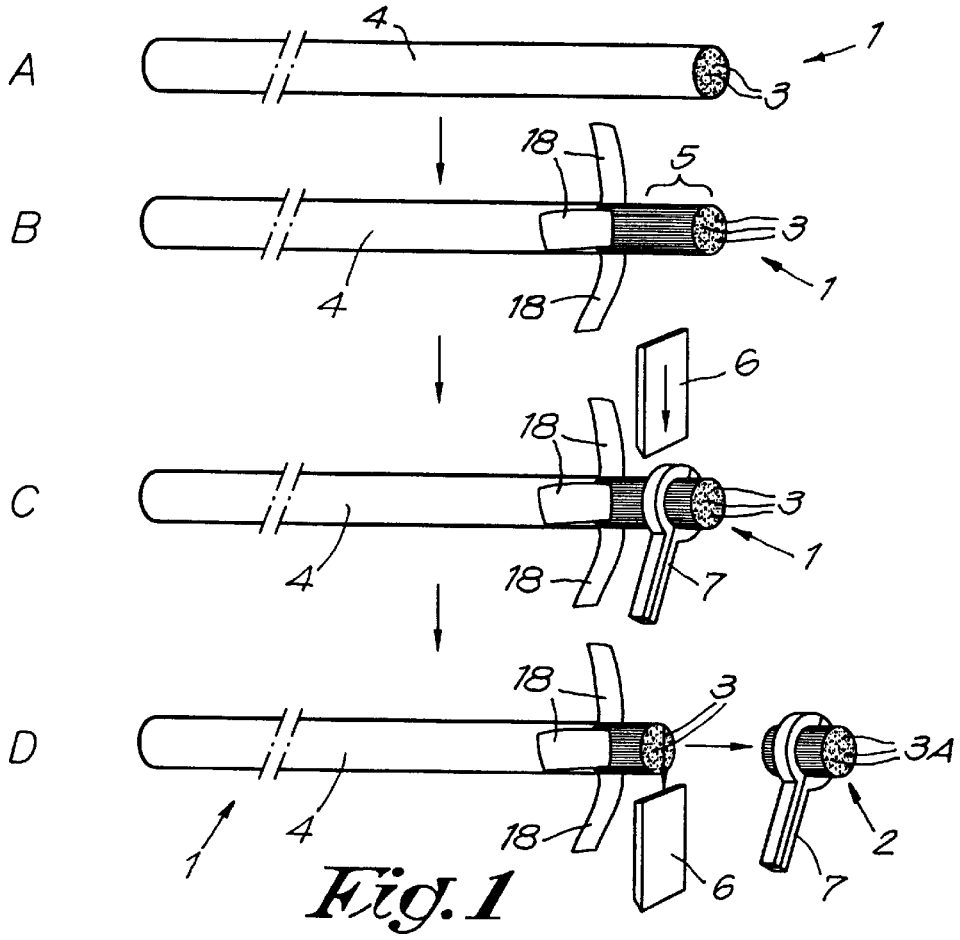
Fig. 1
Fig. 2
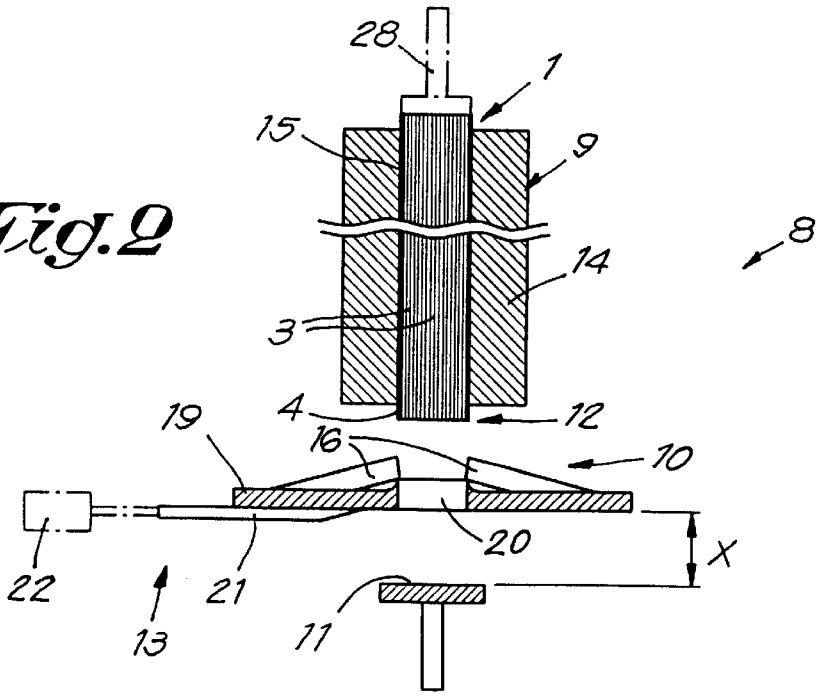

METHOD AND DEVICE FOR FORMING FIBER PACKS FOR MANUFACTURING BRUSHES FROM A FIBER STRAND

BACKGROUND OF THE INVENTION

1. Field of the Invention

The present invention concerns a method and a device for forming fiber packs from a fiber strand, in particular fiber packs which are used for manufacturing brushes.

2. Description of the Related Art

It is known that the fibers for forming brush hairs are packed into fiber strands consisting of parallel fibers which are kept together by means of a cover. These fiber strands, which usually have a diameter of some 5 cm and a length of 1 to 2 m, are cut in parts of the required length at a later stage. Thus are obtained packed fiber packs which can be supplied to a brush manufacturing machine, where the cover is removed from the fiber packs and where the fibers are provided in the fiber magazines.

According to U.S. Pat. No. 4,680,850 of the applicant, the cover of the fibers which are cut at a specific length is removed by partially cutting in the cover and by folding it, such that the fibers are set free over a certain length, and by subsequently grasping the fiber pack with a clamp on the part which has been set free, after which the cover is entirely removed.

From German patent No. 195.25.808 it is known to partially turn up the cover of each part to be cut off from such a fiber strand before cutting off the part concerned. Thus are obtained fiber packs cut at a specific length whose fibers are still kept together by the cover, but which also have a part which has been set free which makes it possible to put a clamp on the fiber pack, after which the cover can be entirely removed from the fiber pack.

SUMMARY OF THE INVENTION

The present invention aims an improved method and device for making fiber packs from fiber strands which are new and which moreover offer several advantages.

To this end, the invention aims a method for forming fiber packs for manufacturing brushes from a fiber strand, whereby fiber packs are formed from a fiber strand which is provided with a cover by cutting off parts of this fiber strand, characterized in that, before such a part is cut off, the cover is entirely removed from said part.

As the cover is already entirely removed from the part to be cut off before this part is cut off from the fiber strand, this offers the advantage that one does need to be particularly cautious when removing the cover, as the fibers of the fiber pack to be formed are still connected to the rest of the fiber strand at that time and thus cannot fall apart.

Also according to the invention, the time-consuming intermediate treatment, which is necessary in the known embodiments in order to remove the cover of the fiber pack which has already been cut off, is excluded.

As the entire fiber part to be cut off is set free according to the invention, the cover does not form an obstacle for providing a clamp, which is the case with the above-mentioned known techniques, as the fibers of the fiber pack are still surrounded by a part of the cover while the clamp is being provided, so that there is little place for the clamp.

Another ensuing advantage consists in that the length of the fiber packs to be cut off is no longer restricted by the manipulations which have to be carried out thereupon later on in order to remove the cover, so that fiber packs with very short fiber lengths, smaller than 2 cm, can be formed and be processed.

It is clear, however, that the fibers to be cut off have to be clamped or inserted in an appropriate device before they are cut off, so that the fiber pack does not fall apart after the fibers have been cut off. Preferably, the fibers of the above-mentioned part are held to this end in a clamping device, after the cover has been removed from this part, but before the part is cut off, so that they can be carried off directly for further manipulation by means of this clamping device.

According to the most preferred embodiment, the cover is systematically removed as the parts are being cut off. As a result, the fibers of the remaining part of the fiber strand remain well arranged.

According to a practical embodiment, the cover is removed by systematically removing it as of the end where the above-mentioned parts are being cut off, whereas the cover on the remaining part of the fiber strand is left untouched.

In particular, the cover is preferably removed by cutting it in the longitudinal direction at one or several places on the perimeter and by carrying off the cut cover sideways.

According to a variant, the cover is removed by unwinding it from the fiber strand.

Although the cover of the rear part of the fiber strand is preferably left untouched, as described above, it is not excluded to remove the cover by either shifting it backward, or by shifting it as a whole like a cylinder, or by turning it up in a zigzag way.

According to a special embodiment, a fixed device is used to remove the cover; the fiber strand is moved through this device; and the fiber strand is lowered through the above-mentioned device, making use of the gravitational force, either or not with the help of additional means.

Practically, the cut-off fiber packs are then straightened by beating them or making them vibrate in an auxiliary device, between two stops, such that all the ends of the fibers are situated in one and the same plane.

The invention also concerns a method for manufacturing brushes, characterized in that the brush fibers are obtained from fiber packs which are formed according to the above-described method.

Further, the invention also concerns a device for forming fiber packs from a fiber strand according to the known method, characterized in that it at least consists of supply means for a fiber strand; means for removing the cover from the fiber strand; a stop for the end of the fiber strand; a cutting device for cutting off parts of the fiber strand which operates in between the means for removing the cover from the fiber strand and the above-mentioned stop; and a clamping device for holding the above-mentioned parts.

BRIEF DESCRIPTION OF THE DRAWINGS

In order to better explain the characteristics of the invention, the following preferred embodiments are described as an example only without being limitative in any way, with reference to the accompanying drawings, in which:

FIG. 1 schematically represents the method according to the invention;

FIG. 2 schematically represents a device for realizing the method of FIG. 1;

DETAILED DESCRIPTION OF THE PREFERRED EMBODIMENTS

Figure 3:
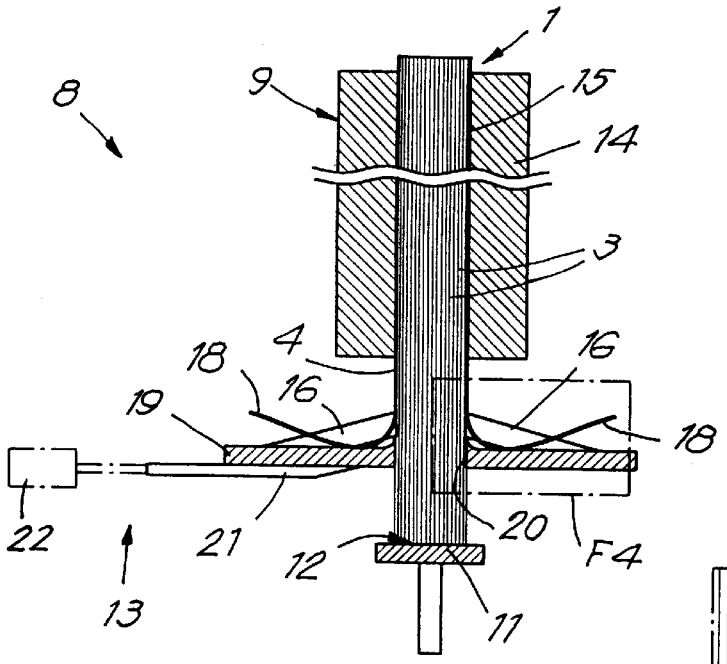
FIG. 3 represents the device of FIG. 2 in another condition.

As is represented in FIG. 1, the invention concerns the processing of fiber strands 1 into fiber packs 2.

The fiber strands 1 are, as represented in step A, supplied in the form of a bundle of parallel fibers 3 around which is provided a cover 4, usually made of paper.

The fiber packs 2 are formed by cutting off parts 5 with a specific length from the fiber strand 1, as a function of the fiber length which is required for manufacturing the brushes.

The invention is special in that, as represented in step B, the cover 4 is entirely removed from the part 5, before this part 5, as indicated in steps C and D, is cut off by means of a knife 6 or such. Before the part 5 is cut of f, the fibers 3 are taken up in a clamping device 7 at the height of the part 5, so that the loose fibers 3A obtained after the cutting are kept together.

As indicated in step D, the cut-off fibers 3A, whose cover 4 has then been entirely removed, can be further manipulated by means of the clamping device 7, as will be further explained hereafter.

In practice, the above-mentioned method can be realized in different ways. An example of a device 8 is described hereafter on the basis of FIGS. 2 to 6.

This device 8 mainly consists of supply means 9 for a fiber strand 1; means 10 for removing the cover 4 from the fiber strand 1; a stop 11 for the end 12 of the fiber strand 1; a cutting device 13 for cutting off parts 5 of the fiber strand 1 which operates in between the above-mentioned means 10 and the above-mentioned stop 11; and a clamping device 7 for holding the above-mentioned parts 5.

In the example of FIGS. 2 to 6, the supply means 9 consist of an upward, in particular vertically upward directed guide 14 forming a passage 15 for the fiber strand 1.

The means 10 consist of one or several, in this case six knives 16 which are erected along the perimeter of the above-mentioned passage 15 or its extension, as well as of a guide 17 for carrying off the cut parts 18 of the cover 4 sideways. The guide 17 is formed of the top side of a plate 19, which is provided with an opening 20 for the fiber strand 1.

The cutting device 13 consists of a knife 21 which can be moved under the above-mentioned guide 14, in particular under the plate 19, by means of a drive element 22.

The above-mentioned stop 11 is situated under the plate 19, such that a fiber strand 1 provided in the guide 14 can rest with its end 12 on the stop 11.

The working of the device 8 is explained hereafter on the basis of the different steps which are represented in FIGS. 2 to 6.

First, a fiber strand 1 is provided in the guide 14, as represented in FIG. 2.

Figure 4:
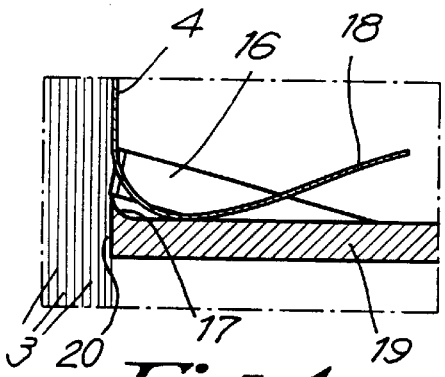
FIG. 4 represents the part indicated by F4 in FIG. 3 to a larger scale.
Figure 5:
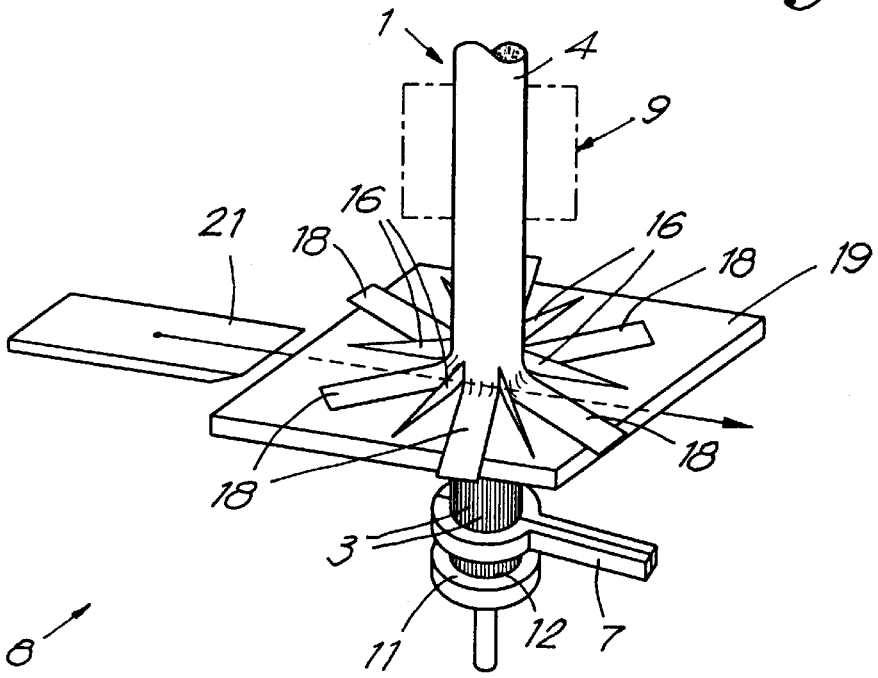
FIG. 5 represents the above-mentioned device in perspective, for practically the same condition as in FIG. 3.

As represented in the FIGS. 3, 4 and 5, the fiber strand 1 slides down under its own weight, until it rests on the stop 11 with its end 12. The cover 4 is hereby cut in the longitudinal direction over its perimeter where the knives 16 are situated. The cut parts 18 are hereby carried off sideways over the top side of the plate 19. Hereby is created a part 5 whose cover 4 has been entirely removed, whose fibers 3 are subsequently grasped by means of the clamping device 7.

Figure 6:
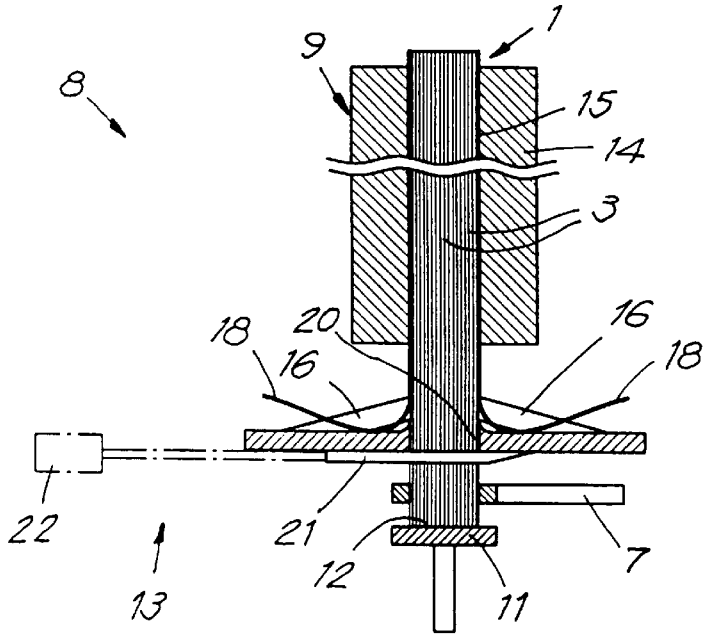
FIG. 6 represents a view analogous to that in FIG. 3, but for yet: another condition.

By subsequently activating the cutting device 13, as represented in FIG. 6, a fiber pack 2 of loose fibers 3A is formed.

It should be noted that the distance X between the cutting device 13 and the stop 11 is preferably adjustable by means of setting means which are not represented, such that the length of the fibers 3A can be adjusted.

It should also be noted that the fiber strand 1, before being cut, can be subjected to a vibrating or beating treatment via the stop 11 so as to make sure that the fibers 3 near the end 12 are all situated in one and the same plane.

Figure 7:
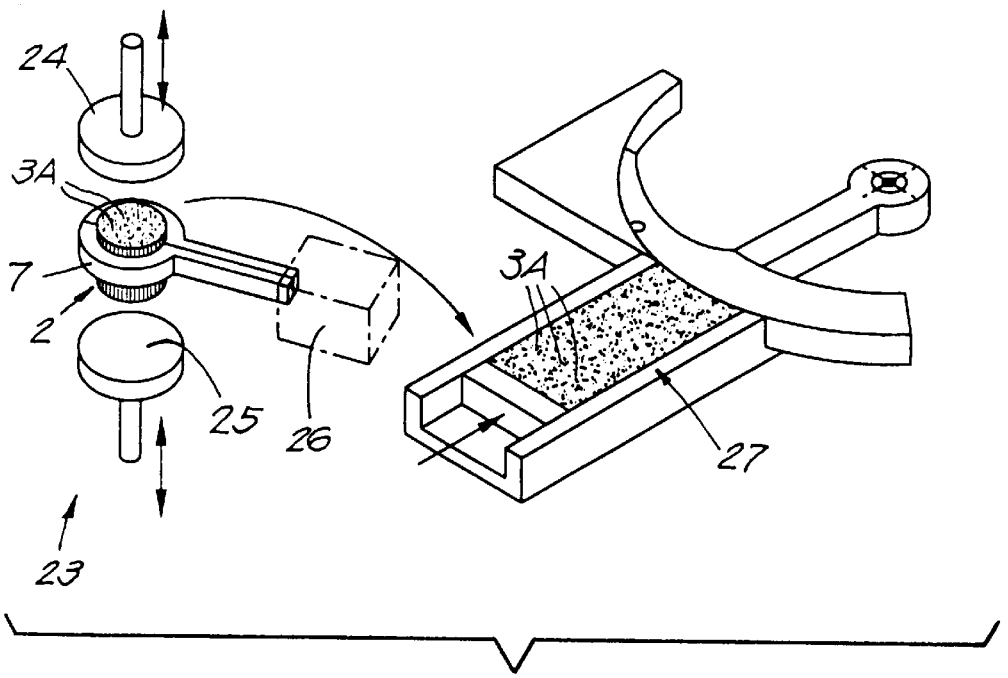
FIG. 7 schematically represents another part of the device.

The device 8 can possibly be equipped, as represented in FIG. 7, with an auxiliary device 23 for setting the ends of the fibers 3A at equal heights again after the cutting, which may cause some shifts. As is represented, this auxiliary device 23 consists for example of two stops 24–25 in between which the fibers 3A are straightened by beating them or by making them vibrate.

It should be noted that the device 8 can be either or not part of a brush manufacturing machine. In case it is part of such a brush manufacturing machine, the whole will be equipped with transfer means 26 which, as is schematically represented in FIG. 7, put the cut-off fiber packs 2 in the fiber magazine 27 with the help of the clamping device 7.

After the lower part 5 has been cut off and removed, the fiber strand 1 drops again, after which the cycle can be repeated. Thus, the cover 4 is systematically removed as the parts 5 are being cut off.

It is clear that the device 8 can be made according to a large number of variants. The fiber strand 1 can for example be set in motion with the help of a press-on element 28. According to a variant, it can also be moved horizontally, provided suitable drive means are used. Moreover, the movement does not necessarily have to be carried out by the fiber strand 1, but it can also be obtained by systematically moving the stop 11 and the cutting device 13.

Figure 8:
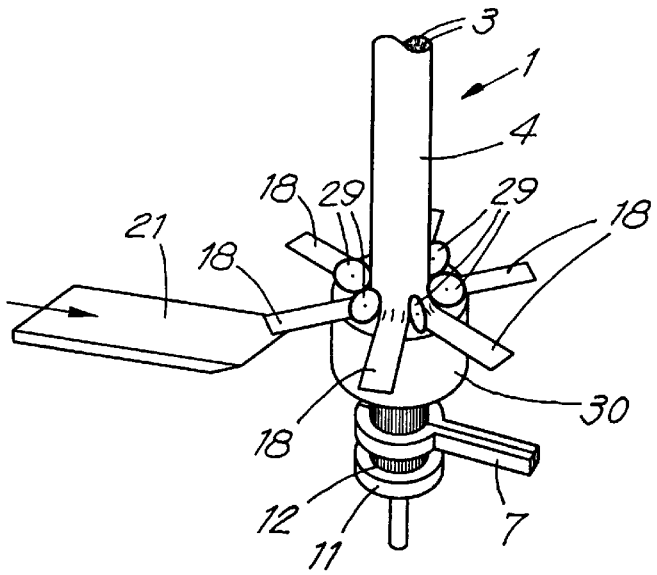
FIG. 8 shows a variant in perspective.

FIG. 8 represents yet another variant whereby the knives for cutting the cover 4 consist of cutting dies 29, whereas the above-mentioned plate 19 has been replaced by a tube part 30.

Naturally, the cover 4 can also be removed in other ways.

Figure 9:
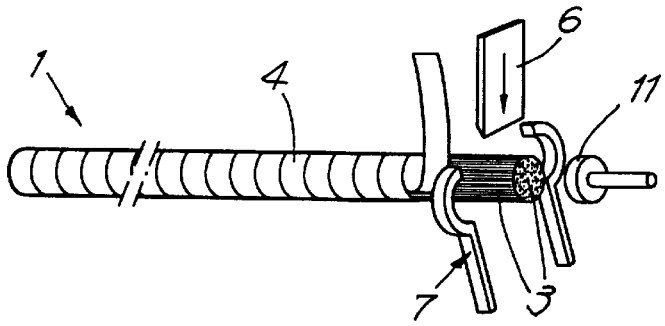
FIGS. 9 and 10 schematically represent two variants for removing the cover from the fiber strand.

FIG. 9 represents a variant whereby the cover 4 is removed by unwinding it from the fiber strand 1. Usually, this unwinding is very easy, as the cover 4 is formed in practice by enveloping the fiber strand 1 like a spiral with a strip, which strip can thus be easily unwound again.

Figure 10:
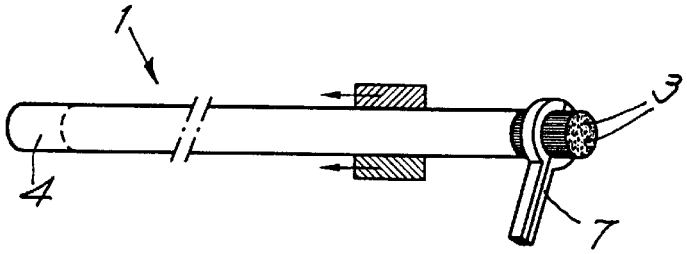

FIG. 10 schematically represents a variant in which the cover 4 is removed by shifting it backward over at least the part 5 to be cut off. In FIG. 10, the cover 4 is shifted backward like a tube, but it is clear that it could also be turned up in a zigzag manner and be pushed away.

According to a variant which is not represented, the fiber strand 1 could also be first stripped of its cover 4 over its entire length and it could be grasped in one or several clamping devices to be then divided in fiber packs.

The method of the invention is particularly appropriate for manufacturing brushes, in particular tooth brushes whereby the fiber bundles consist of simple fibers instead of the conventional double-folded fibers. The length of the inserted fiber bundles hereby mainly coincides with the length of the fibers. Since the fibers are not double-folded in this case, one should take relatively short fiber packs 2 as a basis, which does justice to the method according to the invention.

What precedes does not exclude, however, that the invention can also be applied for manufacturing other brushes, whereby the fibers 3A are either or not double-folded later on.

Figure 11:
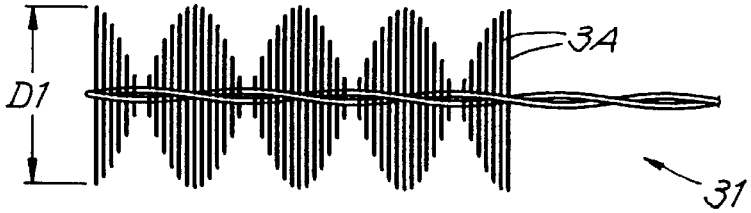
FIG. 11 represents a tooth brush as a section with brush hairs consisting of fibers which are formed of the above-mentioned fiber strands.

The method of the invention is also particularly useful for manufacturing wire-wound brushes, in particular interdental brushes 31 and mascara brushes, as represented in FIG. 11. These types have a small diameter D1 and hence also a short fiber length. When, thanks to the present invention, it is possible to process short fibers during the manufacturing, this leads to less loss of raw materials, as less fibers are cut off.

The invention is by no means limited to the above-described embodiments represented in the accompanying drawings; on the contrary, such a method and device can be made in all sorts of variants while still remaining within the scope of the invention.

Thus, in all the above-mentioned systems for removing the above-mentioned cover 4, use can be either or not made of the gravitational force, in particular of the fiber strands 1 own weight, to make the cover 4 loose.

I claim:

1. A method of forming fiber packs for manufacturing brushes from a fiber strand, comprising the steps of:

providing a fiber strand (1) having a cover (4);

at least partially removing the cover (4) from the fiber strand (1) to expose a part (5) of the fiber strand (1) that is to be cut off; and forming a fiber pack (2) by cutting off the part (5) of the fiber strand (1) after the cover (4) is entirely removed from the part (5).

2. The method according to claim 1, further comprising the step of grasping the part (5) with a clamping device (7) before the part (5) is cut off.

3. The method according to claim 1, wherein an end (12) of the fiber strand (1) at the part (5) is placed against a stop (11) before cutting off the part (5).

4. The method according to claim 1, wherein the cover (4) is systematically removed as additional ones of the parts (5) are cut off.

5. The method according to claim 1, wherein the cover (4) is removed by cutting the cover (4) in a longitudinal direction of the fiber strand (1) at one or more places on a perimeter thereof and by carrying off the cover (4) sideways, after the cover (4) is cut.

6. The method according to claim 5, wherein the fiber strand (1) is carried along a guide (17); the cover (4) at the guide (17) is cut in a longitudinal direction of the strand (1) by at least two fixed knives (16); the cover (4) that is cut is bent off along the guide (17); and the part (5) of the fiber strand (1) which has been exposed by the removal of the cover surrounding the part (5) is cut behind the guide (17) so as to form the fiber pack (2) comprising loose fibers (3A) of a required length.

7. The method according to claim 1, wherein the cover (4) is removed by unwinding the cover (4) from the fiber strand (1).

8. The method according to claim 1, wherein the cover (4) is removed by shifting the cover (4) backwards over at least the part (5) that is to be cut off.

9. The method according to claim 1, wherein a fixed device (8) is used for removing the cover (4); the fiber strand (1) is moved through the fixed device (8), and in order to move the fiber strand (1), the fiber strand (1) is lowered through the fixed device (8) gravitationally.

10. The method according to claim 1, wherein ends of fibers (3A) of the cut ones of the fiber pack (2) are subsequently straightened by beating or vibrating in an auxiliary device (23) between two stops (24–25).

11. The method according to claim 1, wherein fibers (3A) of the cut ones of the fiber pack (2) comprise lengths smaller than 2 cm.

12. The method according to claim 1, including using each fiber pack cut from a strand in a process for manufacturing brushes wherein the fibers of the formed fiber packs are incorporated in brushes.

13. The method according to claim 12, wherein cut fiber packs of the fiber strand (1) are transferred to a fiber magazine (27) of a brush manufacturing machine via a clamping device (7), said clamping device arranged to hold fibers (3A) of the fiber packs (2) while they are being cut and thereafter.

14. The method according to claim 12, wherein the cut fiber packs comprise fibers (3A) that are used for manufacturing tooth brushes wherein the length of each fiber pack to be inserted into the brush coincides substantially with the length of the fibers (3A) constituting the respective fiber pack (2).

15. The method according to claim 12, wherein each fiber pack (2) is used in a process for manufacturing wire-wound brushes (31).

16. A device for forming fiber packs from a fiber strand, the device comprising:

a supply device (9) that supplies a fiber strand (1) with a cover;

a removal device (10) that is arranged to receive a fiber strand and cover and is further arranged to remove a cover (4) from a fiber strand (1);

a stop (11) that receives an uncovered end (12) of a fiber strand after it has been received by the removal device;

a cutting device (13) that is arranged to cut off parts (5) of a fiber strand (1), the cutting device located between the removal device (10) and the stop (11); and a clamping device (7) arranged to hold parts (5) before and after they are cut off from a strand.

17. The device according to claim 16, wherein;

the supply device (9) comprises a guide (14) forming an upright passage (15) for a fiber strand (1);

the stop (11) is situated under the guide (14), such that a fiber strand (1) provided in the guide (14) can rest at lower end (12) of a fiber strand (1) on the stop (11);

the removal device (10) comprises one or morel knives (16–21) which are erected along a perimeter of the passage (15) or an extension thereof, and a removal guide (17) that carrys off cut parts (1) of the cover (4) sideways; and the cutting device (13) is provided under the removal guide (17).

* * * * *